US006805486B2

(12) United States Patent
Smith et al.

(10) Patent No.: US 6,805,486 B2
(45) Date of Patent: Oct. 19, 2004

(54) CLOSURE SYSTEM

(75) Inventors: David D. Smith, Dublin, GA (US); Nobuo Fujisawa, Macon, GA (US); Jerry E. Buchanan, Acworth, GA (US)

(73) Assignee: YKK Corporation of America, Marietta, GA (US)

( * ) Notice: Subject to any disclaimer, the term of this patent is extended or adjusted under 35 U.S.C. 154(b) by 59 days.

(21) Appl. No.: 10/160,155

(22) Filed: Jun. 4, 2002

(65) Prior Publication Data

US 2003/0223658 A1 Dec. 4, 2003

(51) Int. Cl.[7] ..... B65D 33/26
(52) U.S. Cl. ..... 383/92; 383/88; 24/442
(58) Field of Search ..... 383/82, 85, 89, 383/88, 92; 229/76, 77, 78.1, 78.2; 24/442, 443, 444, 452

(56) References Cited

U.S. PATENT DOCUMENTS

| | | | | | |
|---|---|---|---|---|---|
| 693,704 | A | * | 2/1902 | Haberstroh | 229/79 |
| 728,841 | A | * | 5/1903 | Bolsinger | 229/78.1 |
| 1,775,796 | A | * | 9/1930 | Williams | 150/153 |
| 1,974,339 | A | * | 9/1934 | McDonald | 229/80 |
| 2,066,495 | A | * | 1/1937 | Swift | 229/80 |
| 3,079,066 | A | * | 2/1963 | Roop | 383/86 |
| 3,256,941 | A | * | 6/1966 | Rivman | 383/86 |
| 3,446,420 | A | * | 5/1969 | Rinecker | 383/89 |
| 3,642,191 | A | * | 2/1972 | Roof | 229/77 |
| 4,071,186 | A | * | 1/1978 | Ruda | 383/89 |
| 4,192,448 | A | * | 3/1980 | Porth | 229/80 |
| 4,633,508 | A | * | 12/1986 | Sanders | 383/95 |
| 4,795,270 | A | | 1/1989 | Heyden | |
| 4,967,451 | A | * | 11/1990 | Boyn | 24/30.5 R |
| 5,186,373 | A | * | 2/1993 | Taylor | 224/183 |
| 5,692,837 | A | * | 12/1997 | Beer | 383/210.1 |
| 5,911,508 | A | | 6/1999 | Dobreski et al. | |
| 5,944,425 | A | | 8/1999 | Forman | |
| 5,964,399 | A | | 10/1999 | Ruben | |
| 6,079,878 | A | | 6/2000 | Yeager | |
| 6,092,931 | A | | 7/2000 | Tilman | |

FOREIGN PATENT DOCUMENTS

| | | | |
|---|---|---|---|
| DE | 2508746 | * | 9/1976 |

* cited by examiner

*Primary Examiner*—Jes F. Pascua
(74) *Attorney, Agent, or Firm*—Kramer & Amado, P.C.

(57) ABSTRACT

A sheet material which may be used for a closure system adapted to receive surface fasteners. The sheet material may be used for the manufacture of containers, such as bags and provides a primary form of closure as well as a secondary form of closure which allows for tamper proofing an packaged product prior to its initial opening followed by a one or two part secondary closure system.

8 Claims, 3 Drawing Sheets

CLOSURE SYSTEM

BACKGROUND OF THE INVENTION

1. Field of the Invention

Figure 1:
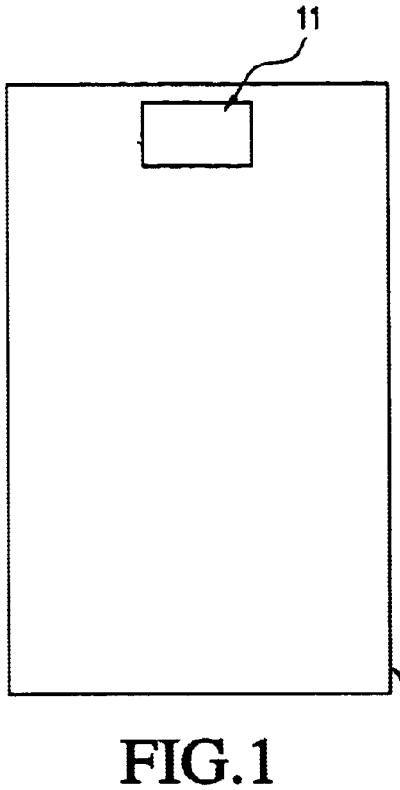

The present invention relates to sheet materials including surface fasteners. In particular, the present invention relates to sheet materials having surface fastening elements which may be used in the field of closures and more particularly in the field of flexible bag closures.

2. Description of Related Art

Sheet materials are used in many industries for the production of a large number of products which ultimately serve a variety of purposes. Some of these uses include the manufacture of webs in the form of one layer articles as well as multilayer laminates which function in the manufacture of containers and receptacles. Containers and receptacles ultimately serve the function of holding a product and therefore require closures for the protection of the container's contents.

Closures currently know in the art may be broadly divided into three categories: a) adhesive attachment closures; b) rail fasteners; and c) hook and loop closures. Adhesive attachment closures are characterized by the use of materials which have different levels of adhesiveness or "tackiness." A large number of adhesives are used in the closure industry to either permanently seal a product, such as a bag, and render the seal inoperable after initial opening or to non-permanently seal a product and allow for repeated opening and closure of a product. The adhesiveness of the material used depends on the particular application and will vary according the peel and sheer strength necessary.

The permanent seal product is commonly known in the industry as a "peel-seal" and after initial adhesion, the product may be opened through pull-apart force. Once this "peel-seal" has been opened, or separated, the properties of the adhesive no longer maintain their adhesiveness or tackiness, thereby preventing resealing of the product. Such a seal is primarily useful with products which will be quickly utilized or consumed, such as snack foods or other edibles which are packaged in small containers. A second benefit of such a seal is that it is tamper-evident and allows a user, which encounters the product, to determine if the closure has been opened. The major drawback to such a closure system is its lack of resealing properties. If a user does not utilize or consume the package contents, a secondary form of closure is necessary. Snack chip bags, such as those used for tortilla or potato chips, are exemplary of this closure system. An entire industry has developed around the need for a secondary closure for such closure systems in the form of "chip-clips" which provide a reusable closure after the peel-seal has been opened.

Non-permanent seal products are also known in the industry and maintain their adhesiveness, or tackiness, after initial opening. These utilize a different type of adhesive that will maintain its adhesiveness after the initial opening of the product. The major convenience offered by such a closure system is based on the ability of a user to initially open a container or receptacle, such as a bag, remove contents, and reseal the container or receptacle. This allows the contents to remain fresh and helping to prevent the intrusion of unwanted objects, such as dust, and organisms, such as insects, into the container. U.S. Pat. No. 4,786,190 ('190), entitled "Reclosable Package Having Outer Reclosable Closure and Inner Non-Reclosable Closure," discloses a bag having wall panes which define a receptacle space. This reference is of interest for showing a bag having a closure system which includes a one-time openable non-reclosable peel seal closure in combination with a reclosable closure system which may be a pressure sensitive adhesive. Although the '190 patent discloses the combination of a peel-seal along with a reclosable closure system, it suffers from its inapplicability to receptacle contents which are in particulate form. If such a package were utilized with products such as snack foods, the pressure sensitive adhesive would immediately adhere portions of the snack food and loose its adhesive abilities. After only a few uses the reclosable portion of the package would be inoperable for its intended purpose and a secondary form of closure would be necessary.

A further disadvantage of the adhesive closure is the adhesive itself. In the comestible food industry, be it for human or animal consumption, the contact between chemical adhesives and food items is not advisable. A further difficulty is presented when the food is intended for animal consumption. Most animals, and especially dogs, have a heightened sense of smell. If a closure system is necessary for a container which will hold dog food, for example, the adhesive closure system will pose a problem due to the aromatic byproducts of the adhesives. Dogs and other animals will avoid food which has been exposed to adhesives or packaged in containers which utilize adhesives. Therefore, adhesive closure systems are only useful under limited circumstances.

Rail fasteners are also well know in the art and are commonly used for closures, particularly bag closures. These assume the configuration of a groove, commonly constructed from plastic, and a corresponding, complementary tongue that fits into the groove to create a closure system. The rail fastener systems, when used for bag closures, provide users with the benefit of a reclosable closure system which does not adhere to the container contents and still allows for repeated use as the contents of the container are used. One drawback to the traditional rail fastener closure system is that it is difficult to utilize. If the tongue and groove are not accurately positioned, the user might attempt, repeatedly, to make the necessary tongue and groove seal without success.

Of even greater concern is when such a seal is utilized in comestible items such as snack foods and pet foods. If the user does not make a proper tongue and groove seal or a partial seal, it might appear that a seal has been made, when only a partial seal has taken place. Such a partial seal allows dust and organisms, such as bacteria or insects, to intrude into the package container, ruining the package contents and possibly jeopardizing the health of the consumer, be it a human or an animal. An alternative form of rail fastener is illustrated in U.S. Pat. No. 4,706,297 ('297), entitled "Foldable Top Bag and Method." The '297 patent discloses a collapsible bag with complementary reclosable fastener structures carried on the outer faces of the upper wall portions. The fasteners may be in the form of complementary, extruded, multi-profile fastener strips having a plurality of resiliently flexible, arrow-shaped profiles. The fasteners strips may also be in the form of a plurality of spaced, parallel, extruded plastic, multi-profile fastener strips. Both of these rail fasteners attempt to solve the problem of accurately matching of the tongue and groove to create a closure by providing either a plurality of resilient flexible, arrow-shaped profiles or a plurality of spaced, parallel, multi-profile fastener strips.

A further form of closure system is the hook and loop fastener. This type of closure typically assumes the configuration of woven or extruded hooks and loops. The loop portion of the fastener system relies on a multiplicity of raised loops which allow for the hook portion of the fastener system to engage. The hook is commonly constructed in a similar manner to the loop portion but usually of a stronger or higher denier thread. If the hook is woven, the loops created after the initial weaving function must be cut, or sheared, to create a severed product. This severed loop is thus transformed into a hook and engages the complementary raised portions of loop to create a hook and loop closure system. If the hook is extruded, it will assume the required shape of a hook upon hardening and similarly engage the raised portion of loop.

Such hook and loop closures provide a great advantage to the reclosable container industry but also lacks the ability to provide a tamper-evident initial closure. If a hook and loop closure system is utilized for comestibles, there is still a need for an initial, tamper-proof closure prior to the initial opening of the product. An even greater difficulty presented by the use of hook and loop closures is the need to adhere the hook and loop elements to the walls of the appropriate sheet material. If the hook and loop closure system is being utilized on a bag closure, it will be necessary to adhere the product to the wall portions of the bag. Such adherence is currently performed through adhesive attachment, thread attachment through a sewing process, or by heat welding the product to the wall portions of the bag.

If the bag is intended to hold comestible items, it is quite common to construct the wall portions with a polyester material, due to the strength and puncture resistance provided. The drawback to the use of polyester in conjunction with a hook and loop closure is that heat welding is not possible with a polyester surface. Because the melting point of polyester is so high, heat welding is not an option, thereby reducing the attachment of the hook and loop elements to a sewing process or adherence with an adhesive element.

It is therefore an object of the preset invention to remedy the inadequacies of the prior art with a sheet material including a surface fastener which may be used in closure systems such as bag closures.

It is a further object of the present invention to provide a sheet material including a surface fastener which allows for the use of complementary hook and loop elements but does not required adhesive bonding.

It is still another object of the present invention to provide a closure system which may be utilized for the closure of containers, such as bags, and which allows for an initial tamper-evident closure along with a secondary, complementary hook and loop closure.

The foregoing objects and advantages of the invention are illustrative of those that can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variation which may be apparent to those skilled in the art. Accordingly, the present invention resides in the novel methods, arrangements, combinations and improvements herein shown and described.

SUMMARY OF THE INVENTION

In accordance with these and other objects of the invention, a brief summary of the present invention is presented. Some simplifications and omission may be made in the following summary, which is intended to highlight and introduce some aspects of the present invention, but not to limit its scope. Detailed descriptions of a preferred exemplary embodiment adequate to allow those of ordinary skill in the art to make and use the invention concepts will follow in later sections.

According to a broad aspect of the invention, a sheet material including a surface fastener is disclosed. The sheet material consists of at least one face which defines at least one opening. A surface fastener having at least one fastening surface which is smaller than the surface fastener. The opening, or openings, are adapted to receive the surface fastener. The surface fastener is bonded to at least one face of the sheet material such that the fastening surface may fasten to another complementary fastening surface.

DETAILED DESCRIPTION OF THE PREFERRED EMBODIMENTS OF THE INVENTION

Figure 2:
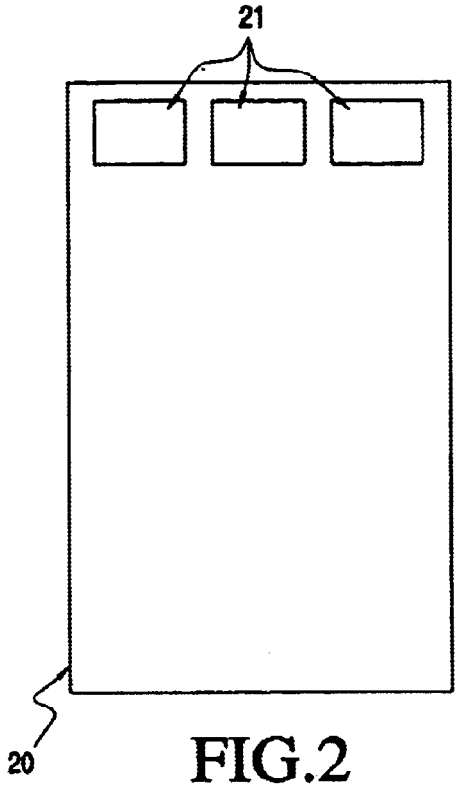
Figure 3:
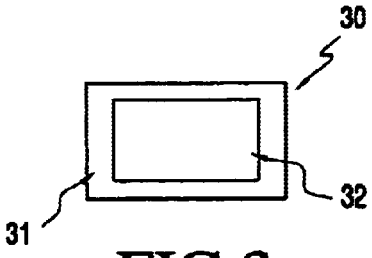
Figure 4:
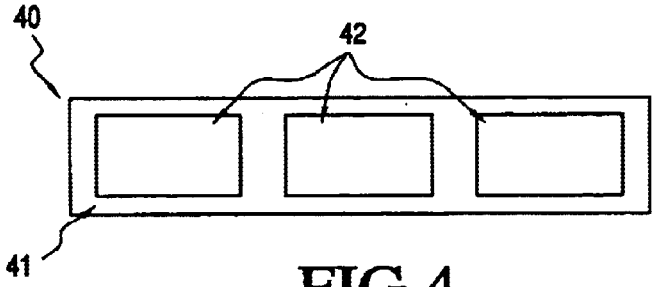

Referring now to the drawings, in which like numerals refer to like components or steps, there is disclosed in FIG. 1 broad aspects of a preferred embodiment of the present invention. FIG. 1 discloses a general arrangement of a sheet material 10, having an opening 11. The sheet material 10 may be a single layer of material, such as polyethylene, or may be constructed from a multi-layer laminate. One example may be one face of the sheet material composed of polyester and the opposite face composed of a heat bondable material, such as polyethylene. The sheet material may be constructed according to any of the know methods of fabricating webs and laminates, such as by extrusion. In a preferred embodiment, the sheet material has one exterior face consisting of polyethylene and an opposite exterior face consisting of polyester. The opening 11, may be formed in any shape, such as circular, triangular, rectangular or other geometric shapes. Furthermore, as shown in FIG. 2, the sheet material 20, may have multiple openings 21. In practice, the surface fasteners 30, 40 shown in FIGS. 3 and 4 are attached to a sheet material 10, 20, as shown in FIGS. 1 and 2. The surface fastener shown in FIG. 3, comprises a central fastening portion 32, flanked around its periphery by a non-fastening portion 31 coated with a heat bondable material such as polyethylene. The surface fastener illustrated in FIG. 4 shows multiple surface fastening regions 42, having non-fastening regions 41 flanking the periphery of the fastening regions 42.

Figure 6:
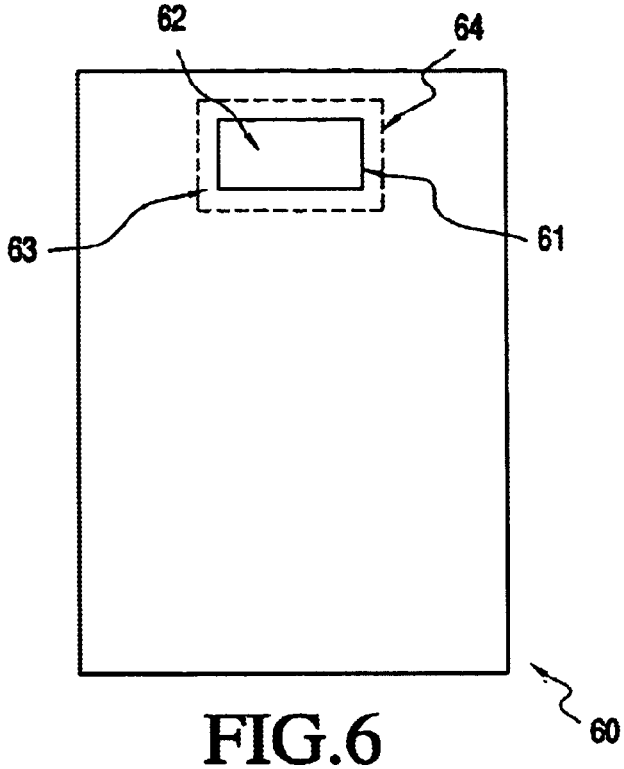

The preferred method of attachment involves the placement of the surface fastener 30 shown in FIG. 3 through the opening 11 shown in FIG. 1. As shown in FIG. 6, the opening 61 is adapted to receive the central fastening portion 62 but not the non-fastening portion 63 of the surface fastener 64. As the surface fastener 64 is placed in contact with the sheet material 60, the central fastening portion 62 protrudes from the face consisting of polyethylene to the face consisting of polyester or alternatively, may only be received in the sheet material 60 such that the fastening portion 62 may fasten to another complementary fastening surface. The polyethylene portion 63 of the surface fastener 64 comes into intimate contact with the polyethylene face of the sheet material 60. Heat and/or pressure may then be applied to the contact region to create a polyethylene to polyethylene bond interface.

Figure 5:
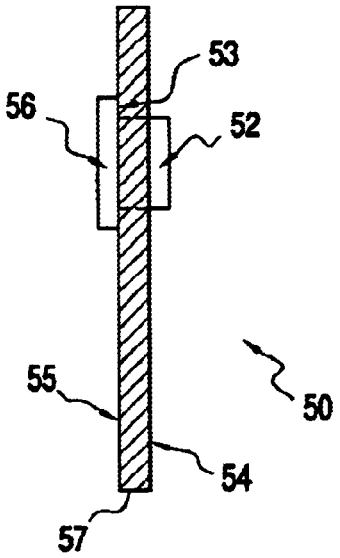
Figure 7:
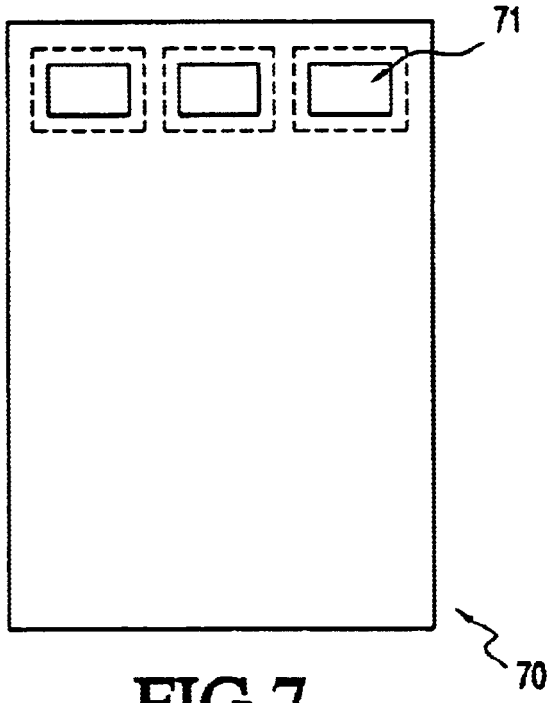

FIG. 5 shows a side view of the interfaced article 50 where the surface fastener 56 protrudes from the polyethylene face 55 through the sheet material 57. The central fastening portion 52 being exposed on the polyester face 54 of the sheet material 57 while being attached through a polyethylene to polyethylene bond interface region 53. The central fastening portion 52 may also be adapted such that it will not protrude from the sheet material utilized but will still function to fasten to another complementary fastening surface. Similarly, as shown in FIG. 7, the interfaced article 70 may include multiple surface fasteners 71 bonded to the sheet material in a similar fashion. Particularly in the manufacture of closures for food articles, the attachment of a fastening element without the need for adhesives proves to be extremely beneficial. Such polyethylene to polyethylene bond interfaces do not produce aromatic byproducts that would deter animals from consuming the contents of the packaging as well as preventing foodstuffs from exposure to harmful chemicals emitted by adhesives.

Figure 8:
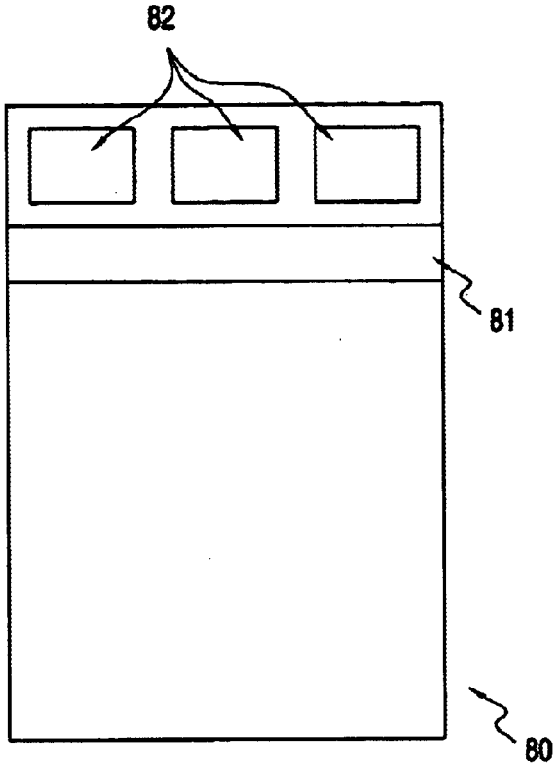
Figure 9:
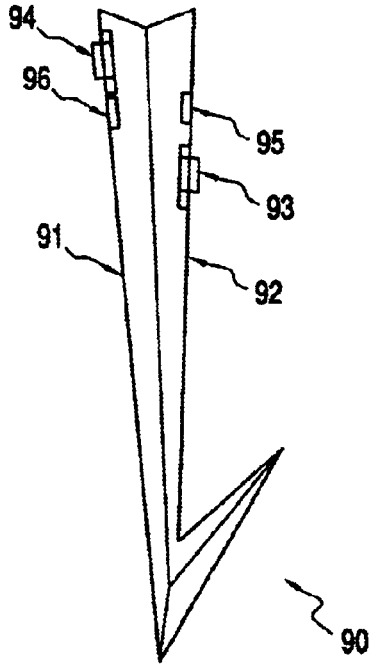
Figure 10:
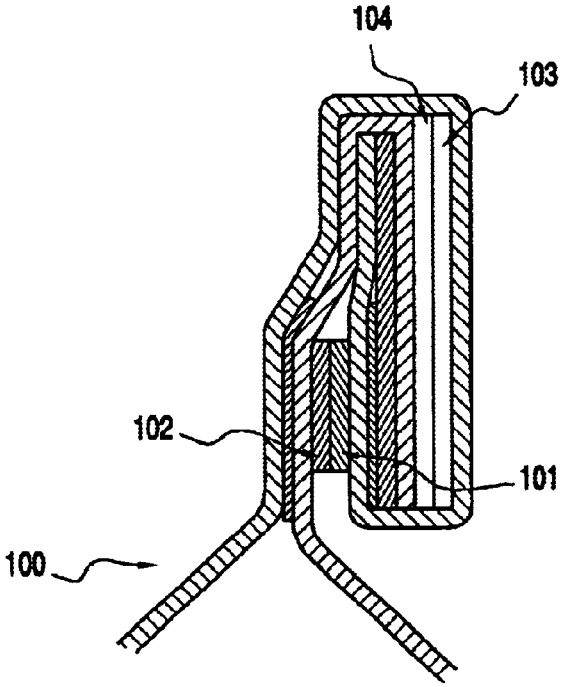

FIG. 8 shows a further embodiment of the present invention illustrating a sheet material utilized as a side wall 80 of a container, such as a flexible bag. A peel seal strip 81 may be attached to the side wall 80 directly below the surface fasteners 82. FIG. 9 shows one embodiment of the present invention, where a bag 90 includes a first wall 91 connected to a second wall 92. The interior faces of each wall consisting of a heat bondable material, such as polyethylene, and a wear resistant exterior consisting of a material, such as polyester. A first surface fastener 94 and a second surface fastener 93 are bonded to the interior walls of the bag in the same way as shown in FIG. 5. The surface fastening portion, such as for example a hook and loop surface or other complementary fastening surface, are then exposed on the exterior face of the bag 90 while a first peel seal strip 95 and a second peel seal strip 96 are also bonded to the interior of the bag 90. As shown in FIG. 10, the bag 100 is folded twice until the first surface fastener 101 and the second surface fastener 102 fasten at their complementary fastening surfaces. The first peel seal strip 103 and the second peel seal strip 104 are also heat sealed to form a closure system.

In use, such a closure system, featuring a peel seal, functions to primarily serve as a tamper evident closure that will protect the contents of the bag prior to its initial use. Once the initial peel seal has been broken, the resin utilized for the peel seal may remain adhesive, or tacky to provide additional sealing capabilities or may be as one time peel seal, which will not remain tacky. The peel seal strip may be constructed from polymeric materials as well as from woven or non-woven material, such as paper board. Preferable, the peel seal strip consists of a paper board material coated with polyethylene. The peel seal strip may then be heat bonded to the interior of the bag and then heat bonded to the opposite peel seal strip. The peel seal strips may also serve additional functions such as allowing for vapor permeability and pressure regulation of the bag interior when in the close state. The peel seal strip may also function as an oxygen scavenging element with the addition of an oxygen scavenger or contain an odor additive to impart a desired smell. Additionally, the peel seal strip may reveal tamper evidency if the contents are exposed to air or function as a temperature indicator for monitoring if the container has been exposed to either heat or cold.

The surface fasteners then provide the closure system with the ability to supplement the first peel seal closure with a secondary form of closure. Furthermore, the peel seal may also function to provide a fold line for the secondary surface fasteners. As the bag is in its open configuration, a first fold may be made using the upper edge of the peel seal as a guide for the fold line. A second fold may then be made using the bottom edge of the peel seal as a second guide for the fold line. The double folding of the upper portion of the bag brings together the surface fasteners into engaging relationship and securing the bag in a twice folded configuration.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A container, comprising:

first and second opposing connected walls defining an opening for a container, the interior of said walls including a heat bondable material;

said first wall defining at least one opening adapted to receive a surface fastener at or substantially proximal to the upper edge of said container;

said second wall defining at least one opening adapted to receive a surface fastener substantially below said upper edge;

at least two surface fasteners having a fastening surface surrounded by a heat bondable material;

said at least two surface fasteners bonded to said heat bondable interior walls such that the fastening surfaces fasten when the upper walls of the container are joined and folded twice.

2. A container according to claim 1, wherein said walls include a peel seal bonded to the interior of said walls such that the walls may be heat sealed.

3. A container according to claim 2, wherein the upper edge of said peel seal provides a fold line.

4. A container according to claim 2, wherein the lower edge of said peel seal provides a fold line.

5. A container according to claim 2, the upper edge of said peel seal provides a fold line for a first fold and the lower edge of said peel seal provides a fold line for a second fold.

6. A container according to claim 1, wherein the surface fasteners are hook and loop fasteners.

7. A closure system, comprising:

at least two connected walls defining an opening, said walls having least one face, wherein at least two of said walls each define at least one opening adapted to receive a surface fastener, a surface fasteners having at least one fastening surface which is smaller than said surface fastener, said at least one surface fastener bonded to the at least one face of at least two walls such that the at least one fastening surface may fasten to at least one other complementary fastening surface on a second wall;

wherein the walls include a polymeric material, a woven material, a non-woven material, a laminate or combinations thereof;

wherein at least one wall has one face including polyester and a second face including polyethylene; and wherein said at least one surface fastener includes at least one layer of polyethylene fastener bonded to said polyethylene face.

8. A sheet material including a surface fastener, comprising:

a sheet material having at least one face defining at least one opening;

a surface fastener having at least one fastening surface which is smaller than said surface fastener;

wherein said at least one opening is adapted to receive the surface fastener, the surface fastener is bonded to the at least one face such that the fastening surface may fasten to another complementary fastening surface;

wherein the sheet material includes a polymeric material, a woven material, a non-woven material, a laminate or combinations thereof; and wherein said surface fastener includes a layer of polyethylene and at least one face of said sheet material includes a layer of polyethylene, thereby allowing the surface fastener and the sheet material to bond at a polyethylene to polyethylene interface.

* * * * *

UNITED STATES PATENT AND TRADEMARK OFFICE

CERTIFICATE OF CORRECTION

PATENT NO. : 6,805,486 B2
DATED : October 19, 2004
INVENTOR(S) : David D. Smith et al.

It is certified that error appears in the above-identified patent and that said Letters Patent is hereby corrected as shown below:

Column 1,
Line 21, delete “know” and insert -- known --.
Line 33, after “according” insert -- to --.
Line 62, delete “helping” and insert -- helps --.

Column 2,
Line 29, delete “know” and insert -- known --.

Column 3,
Line 45, delete “required” and insert -- require --.

Column 4,
Line 30, delete “know” and insert -- known --.

Column 5,
Line 43, delete “Preferable” and insert -- Preferably --.

Column 6,
Line 46, delete the second occurrence of the word “fasteners” and insert -- fastener --.

Signed and Sealed this

Eighth Day of February, 2005

JON W. DUDAS
*Director of the United States Patent and Trademark Office*